US008256761B1

(12) United States Patent
Klein

(10) Patent No.: US 8,256,761 B1
(45) Date of Patent: Sep. 4, 2012

(54) SHEET SEPARATOR HAVING MULTI AXIS MOTION FOR AN IMAGE FORMING DEVICE

(75) Inventor: William Scott Klein, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/189,235

(22) Filed: Jul. 22, 2011

(51) Int. Cl.
*B65H 3/52* (2006.01)

(52) U.S. Cl. ..... 271/121; 271/124; 271/167

(58) Field of Classification Search ..... 271/121, 271/124, 167
See application file for complete search history.

(56) References Cited

U.S. PATENT DOCUMENTS 6,712,351 B2 * 3/2004 Hsieh ..... 271/121
6,908,081 B2 * 6/2005 Takito et al. ..... 271/121
7,172,192 B2 * 2/2007 Mitsuhashi ..... 271/121
8,083,222 B2 * 12/2011 Nakano ..... 271/121
2003/0184004 A1 * 10/2003 Shiohara et al. ..... 271/121
2004/0017039 A1 * 1/2004 Asada et al. ..... 271/121
2004/0032077 A1 * 2/2004 Oh et al. ..... 271/121
2005/0133981 A1 * 6/2005 Mitsuhashi ..... 271/121

FOREIGN PATENT DOCUMENTS

JP 06087544 A * 3/1994

* cited by examiner

*Primary Examiner* — David H Bollinger
(74) *Attorney, Agent, or Firm* — John Victor Pezdek

(57) ABSTRACT

A multi-axis moveable sheet separator for separating media sheets on a media dam having a mount having a plurality of pairs of opposed openings and a spring mount. The sheet separator comprises a spring mounted on the spring mount and a base including a sheet receiving surface having a plurality of lateral detents. Depending from the base are a first plurality of pairs of opposed legs and a second plurality of pairs of opposed legs that are shorter than the first plurality of pairs of opposed leg. When mounted in the media dam, the base compresses the spring. The moveable sheet separator may move with respect to a media receiving surface of the media dam in one of a translational direction, a rotational direction or a combination of both.

19 Claims, 6 Drawing Sheets

SHEET SEPARATOR HAVING MULTI AXIS MOTION FOR AN IMAGE FORMING DEVICE

CROSS REFERENCES TO RELATED APPLICATIONS

This application is related to U.S. patent application Ser. No. 13/189,312, filed Jul. 22, 2011, entitled "SLIDABLE SHEET SEPARATOR FOR AN IMAGE FORMING DEVICE", and also assigned to the assignee of the present application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to image forming devices, and more particularly, to a media dam having a sheet separator having a multi-axis motion for separating media sheets being fed in an image forming device.

2. Description of the Related Art

Typically, an image forming device (such as a printer) includes an apparatus for separating media sheets picked from an input stack and fed into a feed (motion) path of the imaging forming device for an imaging operation (such as printing). Specifically, such an apparatus includes a media sheet separator intended to prevent picking of more than one media sheet at a time.

A variety of means, such as compliant devices including media retarding elements, have been used as sheet separators in image forming devices to accomplish picking of a single media sheet at a time. Further, the compliant devices are used along with a plurality of resistive elements spaced at usually a fixed frequency along a media in a feed path of a media sheet when being picked from an input tray. Such compliant devices are typically of lengths spanning around only a height of a stack of media sheets provided in the input tray. Thus, the compliant devices may be incapable of effectively separating the media sheets being fed into the feed path. One type of resistive elements is in the form of a plurality of dimples on the surface of the media dam, sometimes referred to as a dimpled dam. With dimples, the media sheet being fed encounters a high resistive force resulting in the pick assembly being induced to increase its pick force resulting in a higher force normal to the media stack which in turn increases double feeding of the media, particularly when the media is in a humid environment. Higher pick force also requires greater power from the motor driving the pick assembly with motor stall more likely to occur, especially when feeding heavier media. It would be advantageous to have a media separator that can adjust to the required pick force for a particular media while giving a high resisting force to the second media sheet that has been fed during a double feed condition.

Also, many apparatuses have been designed that include plain or smooth media dams composed of a plurality of metal wear strips provided in the face of the media dam that serve as media sheet separators in input trays carrying the media sheets. Such apparatuses also include a pair of pick rollers that are rotated for feeding the media sheets towards the plain dams. In such apparatuses, a change in feed direction by reversing the pick rollers helps in separating extra media sheets. However, these apparatuses do not effectively prevent multi-feeds of media sheets into a feed path for a printing operation.

It has also been observed that most of the conventional sheet separators on a media dam have the tendency to leave an edge damage mark corresponding to their respective locations on edges of the media sheets. Such marks are undesirable as the marks represent visible defects on printed media sheets. Although, manufacturers of printers/media sheet separators are struggling to eliminate such defects, the problem of separating of the top media sheet from the underlying media sheet without any damage thereto still continues to prevail.

Accordingly, there persists a need for an effective and efficient sheet separator that assists in the separation of a media sheet from underlying media sheets without causing edge damage to the media sheets.

SUMMARY OF THE DISCLOSURE

Disclosed is an apparatus for separating media sheets in an image forming device. The apparatus in one form comprises a supporting member adapted to support a stack of media sheets, a pick assembly disposed upon the stack of media sheets for picking media sheets and feeding the media sheets into a feed path to a processing assembly of the image forming device, and a media dam positioned at a predetermined angle with respect to the supporting member. The media dam is closely positioned to both the leading edges of the media sheets in the stack and to the pick assembly. The media dam includes a sheet receiving surface, a mount having a plurality of pairs of opposed openings and at least one spring mount and at least one sheet separator. The at least one sheet separator comprises at least one spring mountable on the at least one spring mount; and a base. The base includes a sheet receiving surface and a rear surface, the sheet receiving surface of the base having a plurality of lateral detents and a first plurality of pairs of opposed legs and a second plurality of pairs of opposed legs that are shorter than the first plurality of pairs of opposed leg, the first and second pairs of opposed legs depending from the rear surface of the base. The base is mountable on the mount and when mounted compresses the at least one spring and is positioned forward of the sheet receiving surface of the media dam with the first plurality of pairs of opposed legs loosely received into and retained in corresponding openings in the corresponding plurality of opposed pairs of openings in the mount with the second plurality of pairs of opposed legs having their respective distal ends being spaced from and seatable against the mount. The at least one sheet separator moves in one of a translational motion, a rotational motion and a combination of both the translational motion and the rotational motion with respect to the sheet receiving surface of the media dam from a resultant force caused by a force applied by the spring and a force applied by one or more media sheets fed from the stack by the pick assembly and striking the base with the second plurality of pairs of opposed legs limiting the motion of the at least one separator by seating against the mount.

In another form two vertical spaced spring retainers positioned respectively near a top and a bottom of the mount and the two springs, one spring mounted on a respective one of the two spring retainers, are provided. In a further form of the first plurality of pairs of opposed legs at least two pairs of opposed legs has a latch at the distal end of each leg. The latches engage a rear surface of the mount when the base is mounted thereon. A riser of each detent of the plurality of detents is oriented vertically relative to a respective leading edge of each fed media sheet when each fed media sheet arrives at the sheet separator. In one form each riser of each detent of the plurality of detents has a height of about 0.2 mm and a tread of each detent of the plurality of detents has a depth of about 0.07 mm. The height of the base member of the sheet separator is greater than a height of the stack of media sheets and the base member and the plurality of detents of the at least one sheet separator may be composed of glass bead filled polyoxymethylene.

BRIEF DESCRIPTION OF THE DRAWINGS

The above-mentioned features and advantages of the present disclosure, as well as other features and advantages, and the manner of attaining them, will become more apparent and will be better understood by reference to the following description of embodiments of the disclosure taken in conjunction with the accompanying drawings.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

Spatially relative terms such as "front", "rear", "top", "bottom", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present disclosure provides an apparatus for separating media sheets in an image forming device, such as a printer. The apparatus includes a supporting member adapted to support a stack of media sheets. Further, the apparatus includes a pick assembly configured to be disposed upon the stack of media sheets. The pick assembly is adapted to pick media sheets from the stack of media sheets and to feed the media sheets to a processing assembly of the image forming device. The apparatus further includes at least one sheet separator configured adjacent to the stack of media sheets and the pick assembly. Each sheet separator is configured to separate the media sheets being fed from the stack of media sheets to the processing assembly. The apparatus and components thereof of the present disclosure are explained in detail in conjunction with FIGS. 1-6.

Figure 1:
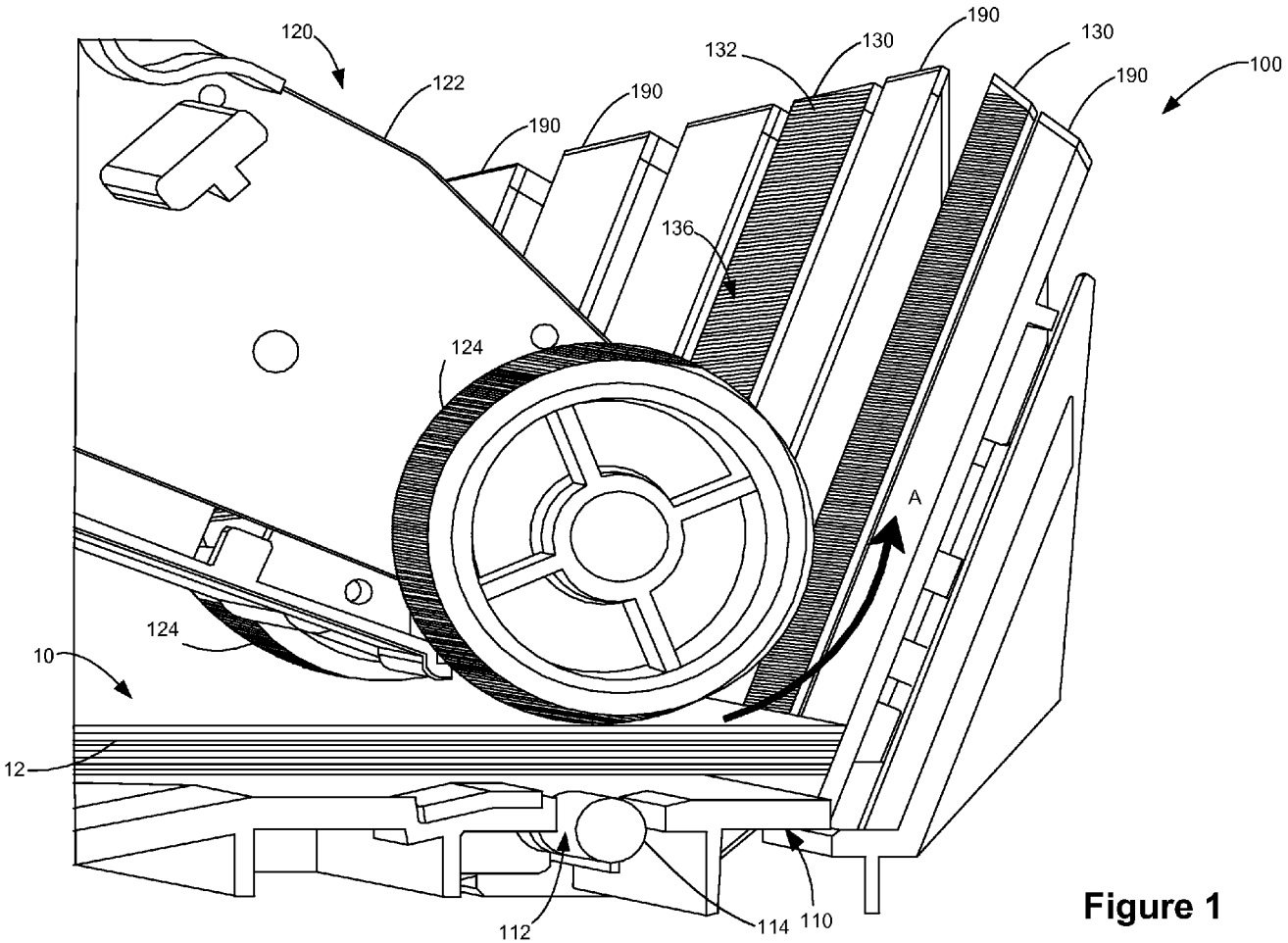
FIG. 1 illustrates a portion of an apparatus for separating media sheets in an image forming device, in accordance with an embodiment of the present disclosure.
Figure 2:
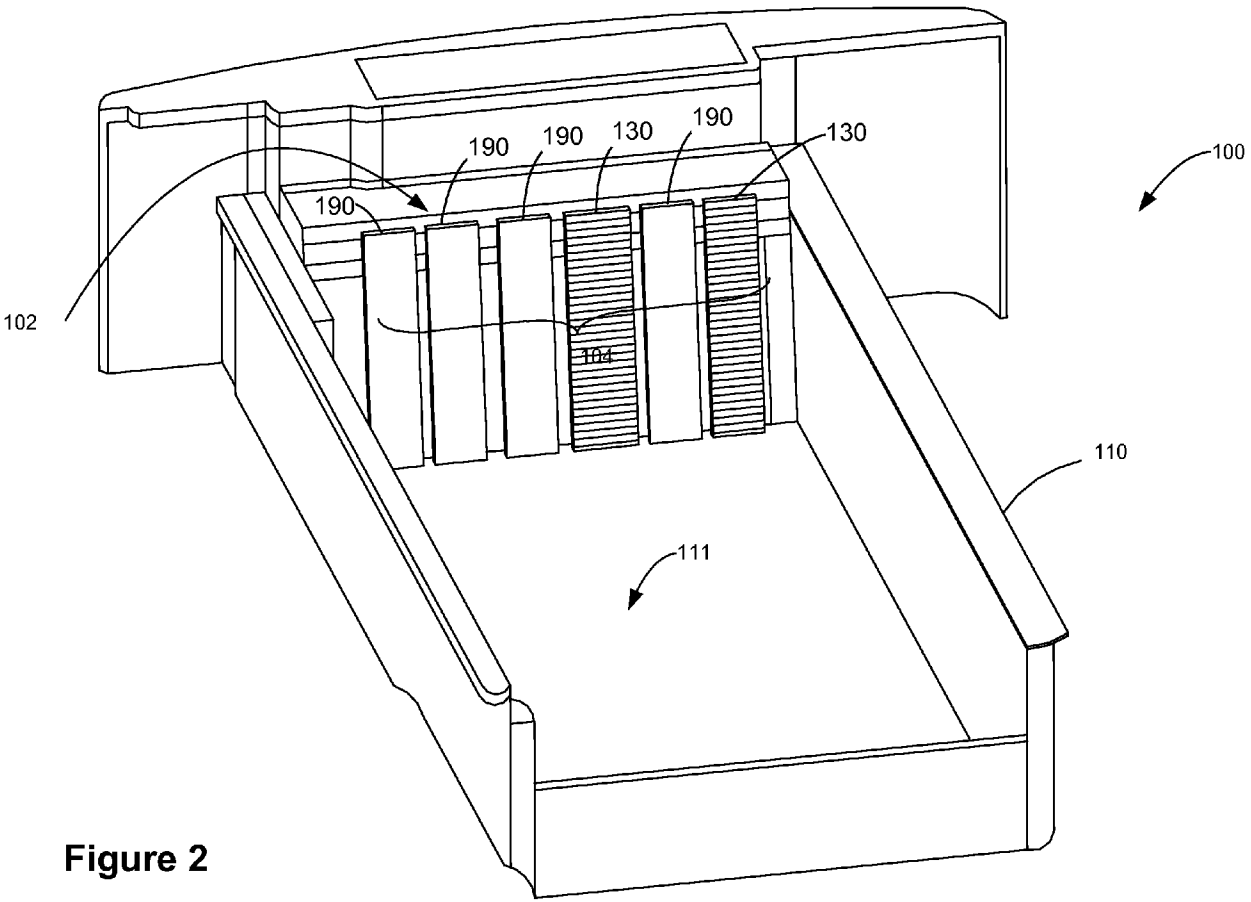
FIG. 2 illustrates a perspective view of the apparatus of FIG. 1, in accordance with an embodiment of the present disclosure.

FIG. 1 depicts apparatus 100 having a media dam 102 for separating media sheets in an image forming device (not shown) and FIG. 2 illustrates a perspective view of the apparatus 100. As depicted in FIGS. 1 and 2, the apparatus 100 includes a supporting member 110. Media dam 102 may be integrally formed with supporting member 110 or may be placed in an abutting relationship with supporting member 110. The media dam 102 has a sheet receiving surface 104 comprised of a generally planar arrangement of moveable and fixed sheet separators 130 and 190 that separate and guide media sheets being fed into a feed path of an image forming device. The supporting member 110 is supports a stack 10 of media sheets 12 (as shown in FIG. 1). For the purpose of this description, the supporting member 110 is depicted to be a rectangular tray for carrying the stack 10 of media sheets 12. As illustrated, media dam 102 forms a front or downstream wall (in relation to the media feed direction A) of the tray. However, the supporting member 110 may be configured to have any shape and size depending on the type of the image forming device. Further, the supporting member 110 may be provided along with the image forming device, and may be detachably attached to the image forming device. Additionally, the supporting member 110 may be capable of supporting a large number of media sheets, such as the media sheets 12. For example, the supporting member 110 may be capable of supporting a sheet capacity of around 500 media sheets 12. However, it is to be understood that the configuration in terms of capacity of the supporting member 110 should not be considered as a limitation to the present disclosure. Further, the media sheets 12 for use in the apparatus 100 may be of any available size, such as A4, A3, Legal and the like.

The apparatus 100 further includes a pick assembly 120 disposed upon the top of the stack 10 of media sheets 12 (as shown in FIG. 1). The pick assembly 120 picks the media sheets 12 from the stack 10, and feeds in a feed direction indicated by the arrow A the media sheets 12 into the media dam 102 where it bends to slide over the sheet receiving surface 104 and then on to a processing assembly (not shown) of the image forming device. The term "processing assembly," as used herein above and below relates to a printing station of the image forming device that refers to a location where a printing operation may be performed.

As depicted in FIG. 1, the pick assembly 120 includes a transmission 122 and a pair of pick rolls 124 being placed/disposed about a leading/front edge of the stack 10 of media sheets 12. Each of the pick rolls 124 of the exemplary pick assembly 120 may have a diameter of about 30 millimeters (mm). Additionally, the pick rolls 124 may be in contact with the media sheets 12 at a distance of about 17 mm to 20 mm from respective front edges of the media sheets 12. Provided in support 110 is a pair of openings 112 in which idler rolls 114 are mounted (see also FIG. 4) that are used to reduce wear on the pick rolls 124 when no media sheet is present on support member 110. It should be understood that the pick assembly 120 may also include other components such as a pick roll shaft, a clutch mechanism, a drive motor and the like, as known in the art. The operation of the illustrated pick assembly 120 to pick or feed media sheets is well known to those of skill in the art.

The media dam 102 of apparatus 100 of FIGS. 1 and 2 includes at least one moveable sheet separator 130 and at least one fixed sheet separator 190 provided on the media dam 102 adjacent to the leading edge of the stack 10 of media sheets 12 and the pick assembly 120. In one embodiment a moveable sheet separator 130 is provided opposite each pick roll 124. The moveable and fixed sheet separators 130, 190 define a sheet receiving surface 104. Moveable and fixed sheet separators 130, 190 may be raised slightly above the surface of the media dam 102 in the range of 0.1 mm to about 2.0 mm, with the moveable sheet separators 130 being raised slightly higher by about 0.1 mm than the fixed sheet separators 190. Moveable and fixed sheet separators 130, 190 may be in close proximity to the stack 10 of media sheets 12 such that a portion of the leading edges of the media sheets lies against a portion of the surface of moveable sheet separator 130. Typically this occurs at a lower portion of the stack 10 near supporting member 110 but may extend the entire height of the stack 10.

The moveable sheet separator 130 is used to separate the media sheets 12 being fed by the pick assembly 120 from the stack 10 to the processing assembly and to inhibit double feeds of two or more media sheets 12. As the media sheets 12 are being moved to the processing assembly, the moveable sheet separator 130 is initially struck by the leading edges the media sheets 12 being fed by the pick assembly 120 and the interaction of moveable sheet separator and the fed media sheets or sheets 12 separates a top most media sheet N from the following media sheets N+1, N+2, etc. located below. Although, the processing assembly has not been shown in the Figures for the purpose of simplicity, the processing assembly is downstream of the sheet separator 130 in the feed direction A.

As depicted in FIGS. 1 and 2, the media dam 102 and the movable and fixed sheet separators 130, 190 are inclined at a predetermined angle, such as an obtuse angle (e.g., 107 degrees) with respect to the supporting member 110 and with respect to the stack 10. Further, the sheet separator 130 is spring biased to provide a resisting force at that is normal to sheet receiving surface 104 of the media dam 102. For example, the base 134 may be positioned at an angle of about 17 degrees from a vertical plane or 107 degrees with respect to supporting member 110. It is to be understood that the angle at which the sheet separator 130 is positioned relative to the stack 10 of media sheets 12, should not be considered as a limitation to the present disclosure, and may be modified depending on the type of the image forming device. Such an alignment of the sheet separator 130 and biasing force facilitates the separation of the media sheets 12 when struck by the leading edges of the fed media sheets 12. The height of the sheet separator base 132 is approximately equal to or greater than to the maximum sheet capacity of supporting member 110 (for example about 50 mm for 500 sheets of 20 pound paper). As shown base 132 extends from slightly below a top surface 111 of support member 110 to proximate the top of the media dam 102. The sheet separator 130 may be composed of glass bead filled polyoxymethylene to prevent wear and maintain rigidity. However, it should be understood that the sheet separator 130 may be composed of any other such material known in the art.

Figure 3:
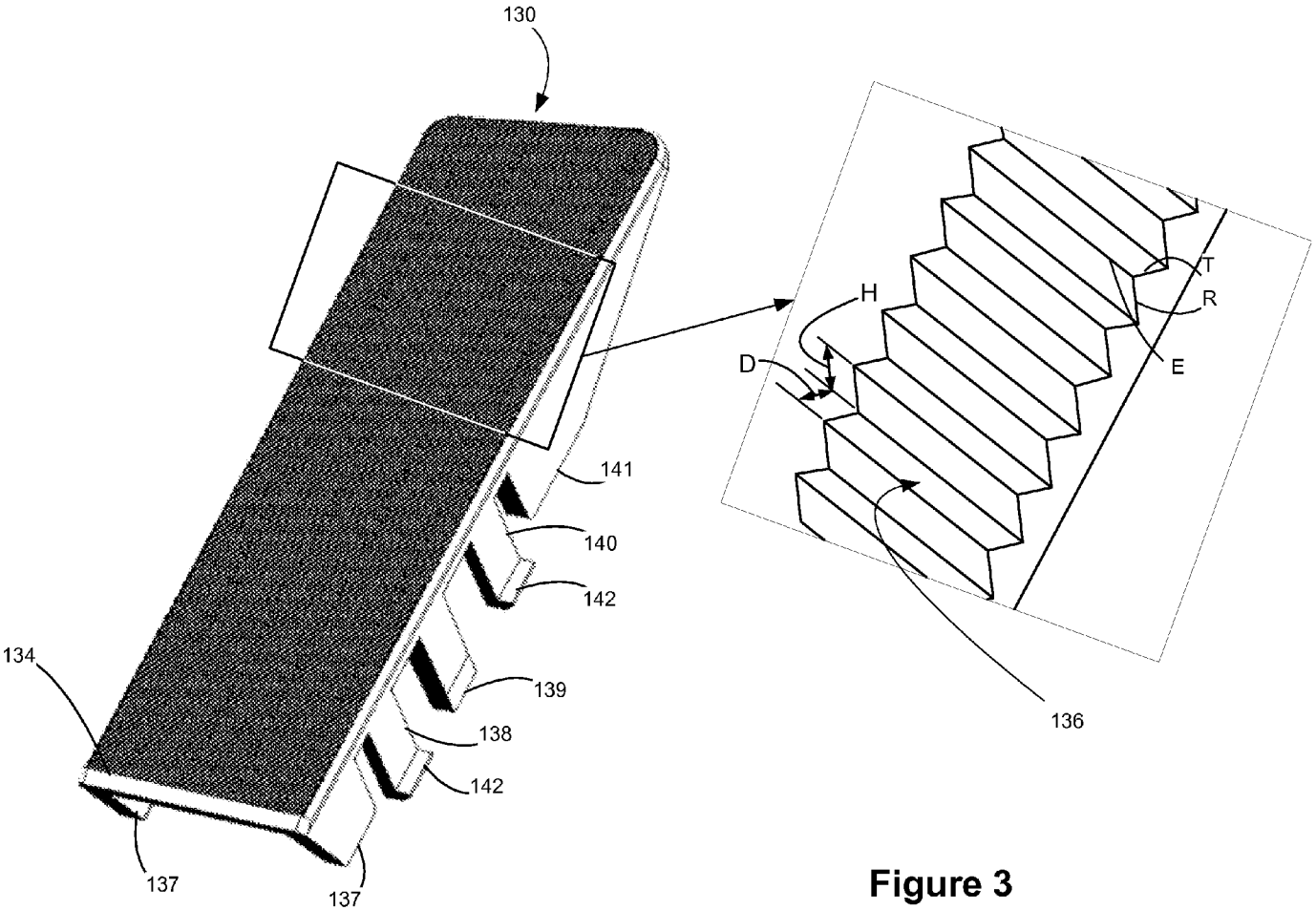
FIG. 3 illustrates a sheet separator of the apparatus of FIGS. 1 and 2, and having an enlarged view to illustrate detent detail in accordance with an embodiment of the present disclosure.
Figure 4:
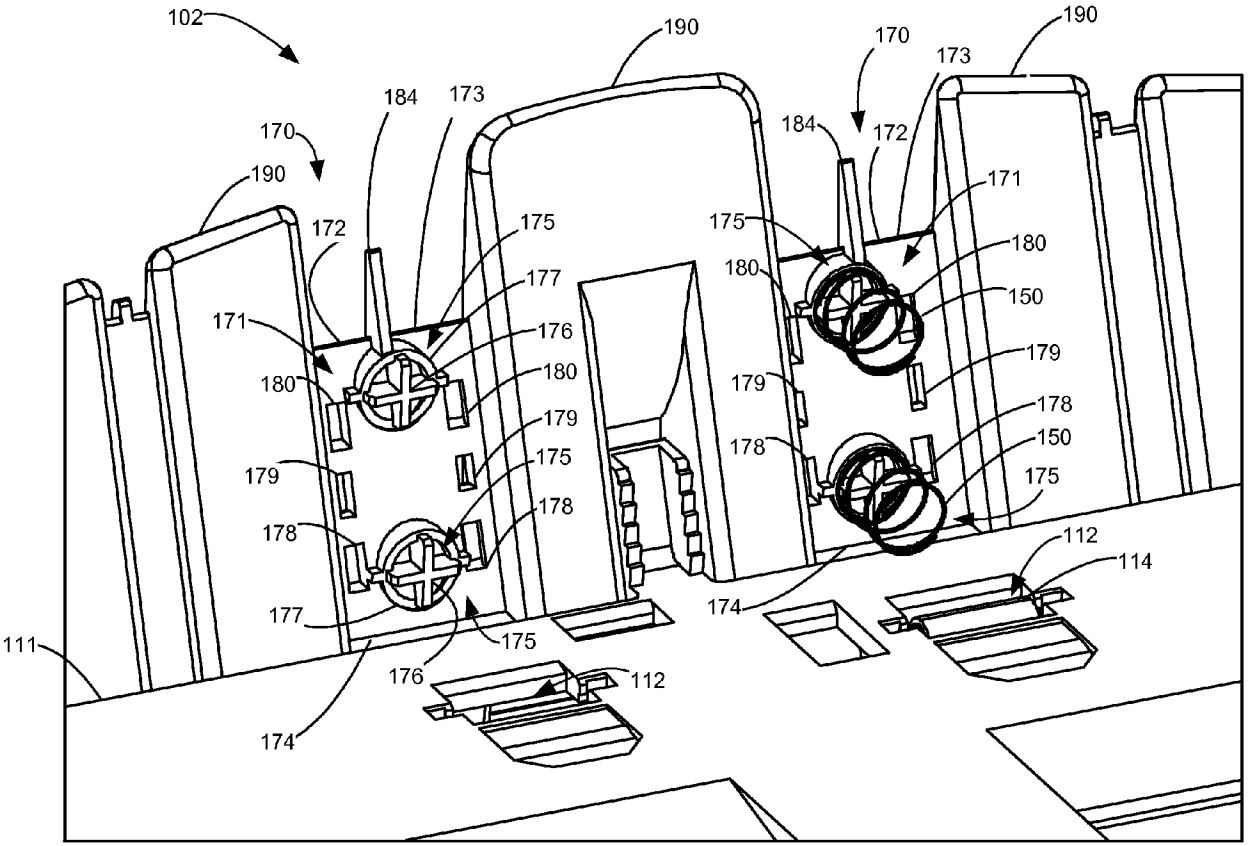
FIG. 4 illustrates multiple mounts for sheet separators along with the biasing springs shown mounted in one of the mounts.
Figure 5:
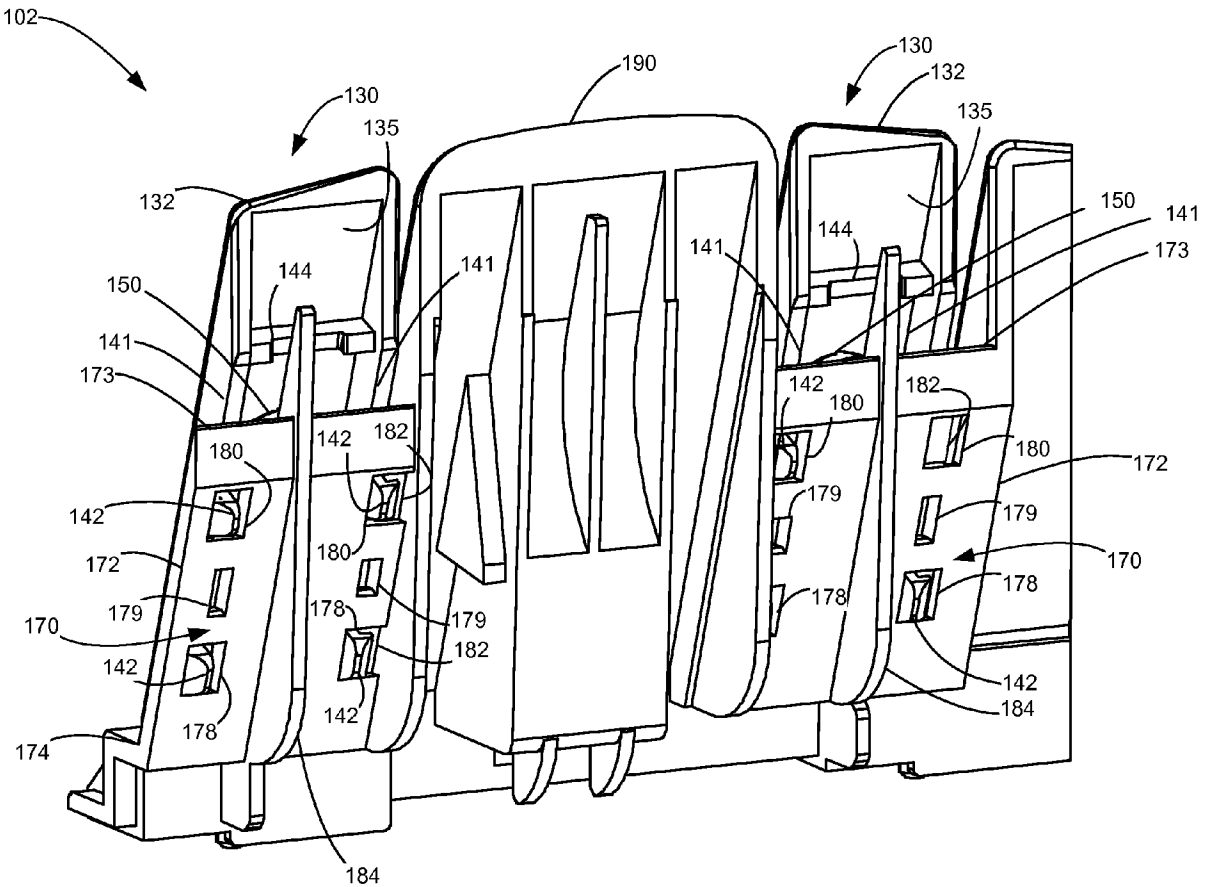
FIG. 5 illustrates a partial rear view of the media dam with the separators members installed.

Referring to FIGS. 3-5, the sheet separator 130 comprises a base 132 and at least one spring 150, such as the two coil springs 150 as illustrated, to provide the biasing force against the base 132. A portion of the media dam 102 forms a mount 170 for base 132 and spring 150. A first plurality of opposed legs pairs 138, 139, 140 and a second plurality of opposed leg pairs 137 and 141 depend from the rear 135 and along the length of base 132 near its outer edges forming a C- or U-shaped cross section. Opposed leg pairs 137-141 are shown as being substantially perpendicular to base 132 although other orientations may be used. A first plurality of opposed leg pairs 138, 139, 140 are longer than a second plurality of opposed leg pairs 137, 141. Opposed leg pair 139 is optional and when present may be used to help with alignment of base 132 onto mount 170. Opposed leg pairs 138, 140 are shown with each leg having a latch 142 at its distal end. As shown the latches 142 are wedge shaped and project outwardly from the surface of the leg. Other orientations and shapes of the latches 142 may also be used. The base 132 has a sheet receiving surface 134, that is struck by the leading edges of the media sheets 12 during feeding, and a back or rear surface 135. The sheet receiving surface 134 is comprised of a plurality of lateral detents 136 in the form of steps (having a riser R and a tread T formation). One or more lateral ribs 144 may be provided on the rear surface 135 of base 132.

The mount 170 has front and rear surfaces 171, 172 and a top 173 and bottom 174. A plurality of pairs of opposed openings 178, 179, 180 correspondingly aligned to opposed leg pairs 138, 139, 140, are provided through mount 170 to receive corresponding leg pairs 138, 149, 140. Latching surfaces 182 are provided on rear surface 172 about each opening in the pairs of opposed openings 178, 180 to receive corresponding latches 142 on the distal ends of leg pairs 138, 140. A pair of spring mounts 175 are provided on front surface 171 between opposed openings 178 and between opposed openings 180. As shown each spring mount 175 comprises a spring retainer 176 and a spring seat 177. Spring retainer 176 is shown have a cruciform shape that projects outwardly from front surface 171. The ends of the cruciform are angled to allow one end of spring 150 to more easily engage with the spring retainer 176 where is retained by friction between spring 150 and spring retainer 176. The end of spring 150 installed on spring retainer 176 abuts against spring seat 177. In one embodiment, the spring seats 177 are substantially perpendicular with respect to support member 110 such that springs 150 are horizontal or parallel to support member 110 and provide a resisting force $F_R$ to act counter to the feeding force $F_F$ provided by the media sheet 12 being feed. While spring mounts 175 are shown as projecting out from front surface 171, other configurations for the mounting or retention of the springs 150 may be used. For example, a recess in front surface 171 corresponding in shape to the end of the spring may be used to retain the spring in place. The angle of the recess may be varied to suit the desired direction for the force to be applied by the springs 150. Alternatively, should a flat spring be used, slots sized to receive the end of the spring may be used. Other features of the mount 170 include a longitudinal rib 184 that projects from the rear surface 172 and extends from the top 173 to the bottom 174 of mount 170. Near the top 173 of mount 170 a portion of longitudinal rib 184 extends beyond front surface 171 and abuts spring seat 177. The mount 170 may be integrally molding as part of the media dam 102 as illustrated or it made be a separate part that is attached to the media dam 102 by commonly used attachments such as screws or snap latches.

Springs 150 are mounted on spring retainers 176 and seat against spring seats 176. Sheet separator 130 is then mounted over springs 150 with opposed legs pairs 138-140 being received into corresponding pairs of opposed openings 178-180. The wedge shape of latches 142 help guide the distal ends of opposed leg pairs 138, 140 through openings 178, 180 and while deflecting them inwardly a slight amount. As latches 142 exit their pairs of opposed openings 178, 180 on the rear surface 135, their opposed leg pairs 138, 140 spring back to their undeflected position and allow latches 142 to seat on corresponding latch surfaces 182 provided on the rear surface 135 next to each opening in the opposed openings pairs 178, 180. With sheet separator 130 installed on mount 170, springs 175 are compressed between sheet separator 130 and the front surface 171 of mount 170 to provide a biasing force against a media sheet 12 that is being fed by pick assembly 120. Opposed leg pairs 138-140 are loosely received into their corresponding pairs of opposed openings 178-180. The difference in the length of shorter opposed leg pairs 137, and 141 and longer opposed leg pairs 138, 140 allows sheet separator 130 to move inwardly or translatively toward the sheet receiving surface 104 on media dam 102 and or rotationally inwardly and outwardly relative to sheet receiving surface 102 depending on the location of where the media sheet 12 being fed strikes sheet separator 130. When opposed leg pairs 137, 141 seat against the front surface 171 of mount 170, further translative motion of sheet separator 130 stops. In one embodiment, transverse rib 144 will seat against longitudinal rib 184 to limit the inward motion (both rotationally and translatively) of sheet separator 130. It will be realized that with the sheet separator 130 mounted and latches 142 engaged, the distance between the latching surfaces 182 to the sheet receiving surface 134 will set the amount by which the sheet receiving surface 134 is offset forward of the sheet receiving surface 104. This distance will also control the amount of compression imposed on springs 150. Thus several different features used singly or in combination may be used to control the offset between the two sheet receiving surfaces 104 and 134 and the amount of resisting force $F_R$ available. For example for heavier media or media having high inter-sheet friction, by having springs with a higher spring force or by appropriately dimensioning the opposed legs pairs 137-141 of sheet separator 130, the resisting force $F_R$ may be increased. Similarly, for lighter weight media or media having lower inter-sheet friction, by having springs with a lower spring force or by appropriately dimensioning the opposed legs pairs 137-141 of sheet separator 130, the resisting force $F_R$ may be decreased. Where sheet separator 130 is installed in a media dam 102 within a removable media tray, this is particularly advantageous, allowing a user to quickly adjust conditions by swapping between media trays set up for the type of media desired to be fed.

Figures 6A, 6B, 6C:
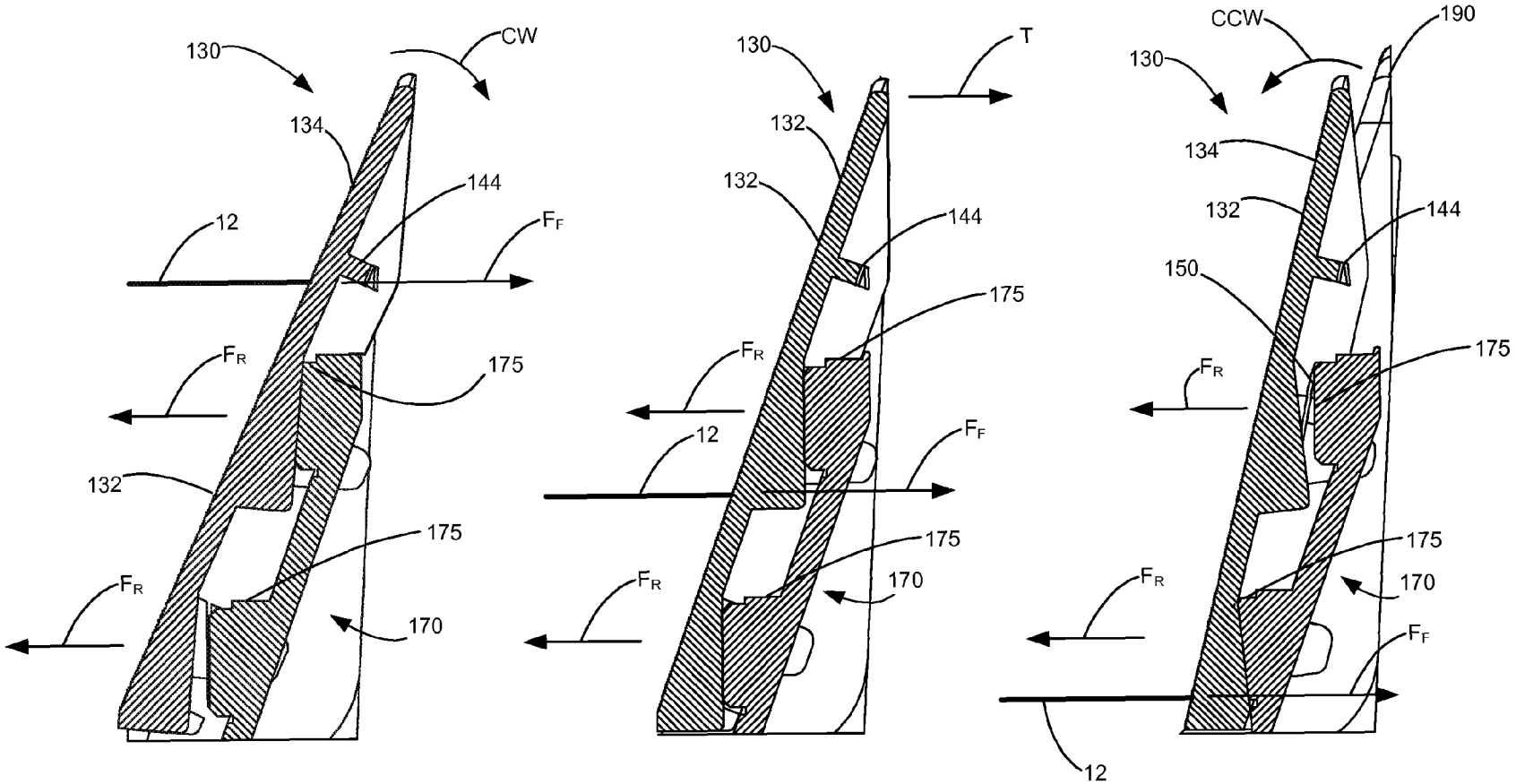
FIGS. 6A-6C are sectional views of one embodiment of the sheet separator illustrating the multi-axis rotational and translational motion of the sheet separator when struck by a fed media sheet at a high location, a middle location, and a low location on the sheet receiving surface of the sheet separator.

Referring now to FIGS. 6A-6C, the multi-axis motion of the sheet separator 130 is illustrated for various feeding positions of the media sheet 12. The motion shown in these figures is exaggerated so that the motion of sheet separator 130 during media sheet feeding can be seen. In FIG. 6A, media sheet 12 is shown striking sheet separator 130 near its top 173 above the uppermost of spring mounts 175. This causes the sheet separator 130 to rotate or rock slightly inward or as viewed clockwise as indicated by the arrow CW. In FIG. 6B, media sheet 12 is shown striking sheet separator 130 between the spring mounts 175. This causes the sheet separator 130 to translate inwardly toward the sheet receiving surface 104 of media dam as indicative by the arrow T. In FIG. 6C, media sheet 12 is shown striking sheet separator 130 near its bottom 174 at or slightly below the lowermost of spring mounts 175. This causes the top of sheet separator 130 to rotate or rock slightly outward or, as viewed, counter-clockwise as indicated by the arrow CCW. At used herein, translational motion of the sheet separator 130 indicates that the sheet separator 130 moves into or out of the plane defined by the sheet receiving surface 104 on the media dam 102 as opposed to moving in a direction parallel to or within the plane defined by the sheet receiving surface 104.

As shown in FIG. 3 the detents 136, and in particular the outer edges E formed between the treads T and risers R form a rippled or serrated sheet receiving surface 134 over which the separated media sheet N may slide (as depicted in an enlarged portion in FIG. 3). The detents 136 may also be in the form of serrations or teeth. The detents 136 are arranged along a portion of the height and a portion of width of the base 132 (as depicted in FIG. 3). The height of the detents 136 would be determined by the capacity of the support member 110 so that detents 136 would be found along the entire height of the stack 10 from the bottom media sheet to the top media sheet of stack 10. Along with the motion of sheet separator 130, the detents 136 aid in separating the top most media sheet N from any below adjacent media sheets N+1 that may also be moving with top most media sheet N as it is being fed. The outer edges E of detents 138 project slightly beyond the sheet receiving surface 104 of media dam 102 and the surfaces of the fixed media sheet separators 190 by a distance of less than 1 mm to engage with the leading edges of the media sheets that are being feed.

As shown in FIG. 3, each detent of the detents 136 has a riser height H of about 0.1 millimeter (mm) and a tread depth D of about 0.07 mm. Further, the height H of the each detent of the detents 136 may be modified as per the requirements and based on a manufacturer's preferences and or thickness of the media sheets. The depth D of the treads T is shallow to facilitate the movement of separated media sheet across sheet receiving surface 134 so that the leading edge of the separated media sheet does not catch on sheet receiving surface 104 as it continues in the feed direction A once it is separated and moving singly. Additionally, the detents 136 may be composed of glass bead filled polyoxymethylene to prevent wear and maintain rigidity. However, it should be understood that the detents 136 may be composed of any other such material known in the art. Further, the detents 136 and the base 132 may be formed as a single rigid molded component for cost-effectiveness. Alternatively, the detents 136 may be configured separately and may be attached to the base 134 by an attachment means, such as an adhesive and the like.

In use, the supporting member 110 carries the stack 10 of media sheets 12 thereupon. The pick rollers 124 of the pick assembly 120 rotate to pick the media sheets 12 one-by-one. However, the pick assembly 120 may pick more than one media sheet from the stack 10 of media sheets 12 at the same time. This is referred to as a double feed. As the topmost media sheet is being picked, the following media sheet or media sheets beneath it are sometimes drawn together with it. This usually happens when the resisting force between the topmost media sheet and the next media sheet is less than the net driving force of the pick assembly 120. Double feeding may also occur on a media having edge weld or media cohesion. Thereafter, the picked media sheets 12 strike at the sheet receiving surface 134 of the sheet separator 130. Subsequently, the arrangement of the base 132 and the detents 136 may facilitate in bubble formation at the respective leading edges of the one or more media sheets that have arrived at the sheet separator 130, thereby, allowing the arrived double fed media sheets to separate prior to proceeding to the processing assembly of the image forming device. Further, the bubble action caused by the sheet separator 130 and the detents 136 further allows the top most media sheet to curve and slide over the detents 136, for an easy separation from the following media sheet. Such an arrangement also prevents the leading edge of each of the double fed media sheets from undergoing any damage while being separated. Bubble formation or bubbling is a slight lifting or floating of the leading edge portion of a media sheet as compared to buckling where the media sheet will deform upwardly, forming a reverse U-shaped section a short distance from the leading edge of the media sheet.

Positioning of the base 132 having the detents 136 thereon with respect to the stack 10 of media sheets 12, aids in formation of bubbles at the respective leading edges of the one or more media sheets when the one or more media sheets arrive at the sheet separator 130, causing the each media sheet to slightly separate from the adjacent media sheet (which also has been picked by the pick assembly 120). The bubble formation, which is a momentary action, allows the top most media sheet to slip over the detents 136 of the base 132 to proceed singly to the processing assembly, while the lower adjacent media sheet is restrained by the detents 136 from proceeding further towards the processing assembly. Such a mechanism takes the advantage of the base 132 that has detents 136 having a height H that is greater than the thickness of each media sheet 12.

Further, the positioning of the base 132 at the predetermined angle relative to the stack 10 of media sheets 12 facilitate orienting the risers R of detents 136 more vertically relative to the respective leading edges of the one or more media sheets 12 that are being fed. Such an orientation of the detents 136 on the inclined base 132 assists in the bubbling action occurring on the each media sheet arriving at the sheet separator 130, thereby, assisting in separation of the topmost media sheet from the following media sheet. It will be evident that the detents 136 may be allowed to orient at any specific angle, as per the requirements of the image forming device and the manufacturer's preference.

Moreover, as depicted in FIGS. 1 and 2, the media dam 102 may also include one or more fixed sheet separators 190 (plain or smooth dams) composed of metal wear strips along with one or more moveable sheet separators 130 within the media dam 102. The fixed sheet separators 190 may also assist in separating the media sheets 12. Further, the pick rolls 124 may be closely positioned to the sheet separators 130, 190 by about 20 mm.

The configurations of base (such as the base 132) and detents (such as the detent 136) of the sheet separator 130 of the present disclosure assist in an effective and efficient separation of media sheets in the image forming device. Further, the apparatus 100 and the sheet separator 130 are suitable for implementation in printers having L-shaped, C-shaped and S-shaped feed paths, for printing operations. Additionally, the sheet separator of the present disclosure may also be incorporated as a media dam in a detachable supporting member (tray) of an image forming device by molding features into the detachable supporting member, thereby, reducing part count and overall machine cost. Moreover, use of the sheet separator of the present disclosure averts possible damage to the media sheet being separated, thereby, averting deterioration of quality of the finally printed media sheet.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. An apparatus for separating media sheets in an image forming device, the apparatus comprising:

a supporting member adapted to support a stack of media sheets;

a pick assembly disposed upon the stack of media sheets for picking media sheets from the stack of media sheets and feeding the media sheets into a feed path to a processing assembly of the image forming device; and a media dam positioned at a predetermined angle with respect to the supporting member, the media dam closely positioned to both the leading edges of the media sheets in the stack and to the pick assembly, the media dam including a sheet receiving surface, a mount having a plurality of pairs of opposed openings and at least one spring mount and at least one sheet separator;

the at least one sheet separator comprising:

at least one spring mountable on the at least one spring mount; and a base, the base including:

a sheet receiving surface and a rear surface, the sheet receiving surface of the base having a plurality of lateral detents; and a first plurality of pairs of opposed legs and a second plurality of pairs of opposed legs that are shorter than the first plurality of pairs of opposed leg, the first and second pairs of opposed legs depending from the rear surface of the base;

the base being mountable on the mount and when mounted compressing the at least one spring and being positioned forward of the sheet receiving surface of the media dam with the first plurality of pairs of opposed legs loosely received into and retained in corresponding openings in the corresponding plurality of opposed pairs of openings in the mount with the second plurality of pairs of opposed legs having their respective distal ends being spaced from and seatable against the mount;

wherein the at least one sheet separator moves in one of a translational motion, a rotational motion and a combination of both the translational motion and the rotational motion with respect to the sheet receiving surface of the media dam from a resultant force caused by a force applied by the at least one spring and a force applied by one or more media sheets fed from the stack by the pick assembly and striking the base with the second plurality of pairs of opposed legs limiting the motion of the at least one separator by seating against the mount.

2. The apparatus of claim 1, wherein the at least one sheet separator is two sheet separators each positioned opposite a corresponding pick roll in the pick assembly.

3. The apparatus of claim 1, wherein the at least one spring retainer is two vertical spaced spring retainers positioned respectively near a top and a bottom of the mount and the at least one spring is two springs, one spring mounted on a respective one of the two spring retainers.

4. The apparatus of claim 1, wherein the first plurality of pairs of opposed legs includes at least two pairs of opposed legs wherein each leg has a latch formed at the distal end thereof, the latches engaging a rear surface of the mount when the base is mounted thereon.

5. The apparatus of claim 1, wherein the mount is molded within the media dam.

6. The apparatus of claim 1, wherein a riser of each detent of the plurality of detents is oriented vertically relative to a respective leading edge of each fed media sheet when each fed media sheet arrives at the at least one sheet separator.

7. The apparatus of claim 1, wherein the sheet receiving surface of the sheet separator facilitates bubble formation at respective leading edges of the top most media sheet and the adjacent media sheet when the top most media sheet and the adjacent media sheet arrive at the base member.

8. The apparatus of claim 1, wherein each riser of each detent of the plurality of detents has a height of about 0.2 mm.

9. The apparatus of claim 1, wherein a tread of each detent of the plurality of detents has a depth of about 0.07 mm.

10. The apparatus of claim 1, wherein the height of the base member of the at least one sheet separator is greater than a height of the stack of media sheets.

11. The apparatus of claim 1, wherein the base member and the plurality of detents of the at least one sheet separator are composed of glass bead filled polyoxymethylene.

12. In a media tray of an image forming device holding a stack of media sheets, a media dam forming a portion of a front wall of the media tray and positioned at a predetermined angle with respect to a bottom surface of the media tray, the media dam separating media sheets being fed by a pick assembly from the stack of media sheets into the media dam and then along a feed path to a processing assembly in the image forming device, the media dam comprising:

a sheet receiving surface formed in part by two moveable sheet separators, the moveable separators extending from the bottom surface of the tray toward a top of the front wall of the media tray;

two mounts within the front wall of the media tray, each mount having a plurality of pairs of opposed openings and two vertically spaced apart spring mounts one of which is positioned near the bottom surface of the tray;

each of the two moveable sheet separators mountable on a respective one of the two mounts, each moveable sheet separator comprising:

two springs each mountable on a corresponding spring mount of its respective mount; and a base, the base including:

a sheet receiving surface and a rear surface, the sheet receiving surface of the base having a plurality of lateral detents; and a first plurality of pairs of opposed legs and a second plurality of pairs of opposed legs that are shorter than the first plurality of pairs of opposed legs, the first and second plurality of pairs of opposed legs depending from the rear surface of the base;

the base being mountable on the mount and when mounted compressing the two springs mounted on their respective spring mounts, the sheet receiving surface of the base being positioned forward of the sheet receiving surface of the media dam with the first plurality of pairs of opposed legs loosely received into and retained in corresponding openings in the corresponding pair of opposed openings in the mount and the second plurality of pairs of opposed legs being spaced from and seatable against the mount;

wherein the two sheet separators each move in one of translational motion, rotational motion and a combination of both the translational motion and the rotational motion with respect to the sheet receiving surface of the media dam from a resultant force caused by a force applied by the two springs and a force applied by one or more media sheets fed from the stack by the pick assembly striking the base of each of the two sheet separators with the second plurality of pairs of opposed legs of each of the two sheet separators acting to limit the motion thereof by seating against their respective mounts.

13. The media tray of claim 12, wherein the first plurality of pairs of opposed legs includes at least two pairs of opposed legs wherein each leg has a latch formed at the distal end thereof.

14. The media tray of claim 13, wherein each latch is wedged shaped to guide the distal end of its respective leg into the corresponding opening in the corresponding pairs of opposed openings with the latch engaging the rear surface of the base upon exiting its corresponding opening.

15. The media tray of claim 14 wherein for each moveable sheet separator the distance between each latch and the rear surface of the base is equal and determines the amount of compression of the two springs.

16. The media tray of claim 12 wherein the first plurality of pairs of opposed legs are positioned between the second plurality of pairs of opposed legs.

17. The media tray of claim 12 wherein for each moveable sheet separator, the difference in length between the first plurality of pairs of opposed legs and the second plurality of pairs of opposed legs determines the amount of translational motion thereof.

18. The media tray of claim 12, wherein a riser of each detent of the plurality of detents is oriented vertically relative to a respective leading edge of each fed media sheet when each fed media sheet arrives at the at least one sheet separator and each riser of each detent of the plurality of detents has a height of about 0.2 mm and a tread of each detent of the plurality of detents has a depth of about 0.07 mm.

19. In a media tray of an image forming device holding a stack of media sheets, a media dam forming a portion of a front wall of the media tray and positioned at a predetermined angle with respect to a bottom surface of the media tray, the media dam having a moveable sheet separator assembly, the moveable sheet separator assembly comprising:

a mount having a plurality of pairs of opposed openings therethrough and a pair of two vertically spaced apart spring mounts on a front surface thereof, one of the pair of spring mounts being positioned near the bottom surface of the tray, each spring mount including a spring seat and a spring retainer;

two springs, each spring being held by a respective spring retainer with an end of each spring seating on a respective spring seat; and a base, the base including:

a sheet receiving surface and a rear surface, the sheet receiving surface of the base having a plurality of lateral detents extending across the sheet receiving surface of the base; and a first plurality of pairs of opposed legs wherein at least two pairs of opposed legs thereof have a wedge shaped latch on a distal end of each leg;

a second plurality of pairs of opposed legs that are shorter than the first plurality of pairs of opposed legs, the first and second plurality of pairs of opposed legs depending from the rear surface of the base with the first plurality of pairs of opposed legs positioned between the second plurality of pairs of opposed legs;

the base being mountable on the mount and when mounted compressing the two springs mounted on their respective spring mounts, the sheet receiving surface of the base being positioned forward of a sheet receiving surface of the media dam with the first plurality of pairs of opposed legs loosely received into and retained in corresponding openings in the plurality of pairs of opposed openings in the mount, the latches guiding the distal ends of the at least two pair of opposed legs into and through corresponding pairs of opposed openings in the mount and engaging a rear surface of the mount with the second plurality of pairs of opposed legs being spaced apart from and seatable against the mount;

wherein the sheet separator moves in one of a translational motion, a rotational motion and a combination of both the translational motion and the rotational motion with respect to the sheet receiving surface of the media dam from a resultant force caused by a force applied by the two springs and a force applied by one or more media sheets striking the base of the moveable sheet separator with the second plurality of pairs of opposed legs acting to limit the motion thereof by seating against the mount.

* * * * *